United States Patent [19]

Groves

[11] Patent Number: 4,991,838

[45] Date of Patent: Feb. 12, 1991

[54] MARKED BASEBALL COVER AS TRAINING AID AND METHOD FOR USE

[76] Inventor: Keith N. Groves, 1779 E. 4500 South, Salt Lake City, Utah 84124

[21] Appl. No.: 506,098

[22] Filed: Apr. 9, 1990

[51] Int. Cl.[5] ..... A63B 69/00

[52] U.S. Cl. ..... 273/26 R; 273/58 R; 273/60 R; D21/204; 40/327

[58] Field of Search ..... 273/58 C, 58 R, 60 B, 273/58 A, 58 B, 424, 58 P, 58 D, 58 E, 58 J, 61 R, 58 K, 60 R, 63 C; D21/204; 40/327

[56] References Cited

U.S. PATENT DOCUMENTS 4,302,901 12/1981 Psyros ..... 273/42 X 4,919,422 4/1990 Ma ..... 273/60 B

FOREIGN PATENT DOCUMENTS 3012 of 1912 United Kingdom ..... 273/232

22179 of 1912 United Kingdom ..... 273/232

420410 11/1934 United Kingdom ..... 273/232

*Primary Examiner*—Theatrice Brown

[57] ABSTRACT

A new type of baseball suited for use as a training aid, particularly for pitchers, catchers, and hitters comprising a conventional baseball having a colored lined marking on the cover, and preferably a red colored stripe spiralling downward from the top of the ball to the bottom.

2 Claims, 2 Drawing Sheets

MARKED BASEBALL COVER AS TRAINING AID AND METHOD FOR USE

BACKGROUND OF THE INVENTION

1. Field of the Invention

This invention relates to a baseball, and more particularly to a baseball having a surface cover which is marked in a certain manner to assist the players in training.

Specifically, the invention provides a new type of baseball having a cover marked in such a way as to a very helpful training aid for a pitcher, catcher and hitter The new baseball comprises a convention hard baseball having a colored marking on the sufface, and preferably a red marking, in a variety of patterns, such as a single colored strip spiralling downward starting at the top of the ball between the seams and going completely around the ball surface and ending at the bottom side between the seams, a red stripe which may take the path of the conventional seams on the baseball, or still more preferably a multicolored marking to effect a quick color change as the ball is thrown.

2. Prior Art

In the game of baseball, one of the most difficult skills to master is hitting the ball. Another difficult task is to develop a pitcher that is able to use a variety of pitches such as fast ball, slider, etc. to confuse the batter. A further difficult skill is that of being able to catch the ball and in some way communicate with the pitcher the type of pitch thrown and the right type to throw to get this batter out.

It would be a great advance in the field of baseball if one could develope a means for assisting in the development of the above-noted skills.

It is an object of the invention, therefore, to develope a marked baseball that could be used to assist ihe pitcher, batter and catcher in their important assignments. It is a further object to provide a new marked baseball thatcan help the pitcher follow the ball into the catcher's glove, and thus teach him the type of ball just thrown. It is a further object to provide a marked baseball that can help the batter follow the ball to determine if it is coming in his hitting zone. It is a further object to provide a new marked baseball that will assist the catcher in his assigned tasks. These and other objects of the invention will be apparent from the following detailed des ription thereof.

SUMMARY OF THE INVENTION

It has now been discovered that these and other objects may be accomplished by the new marked baseball covers of the present invention which presents for the first time an efficient and economical way for the training of young baseball players, such as pitchers, batters and catchers.

The new marked baseballs of the present invention comprise a conventional baseball having a colored marking on the surface of the cover, the marking taking a variety of forms and designs as shown hereinafter.

The new baseballs have many unexpected advantages. For Example, when the ball is marked so as to have a colored spiral marking around the outside cover, the ball when thrown as a curve slider or fast ball, the colored strips makes a colored dot appearance on the ball, and this helps the pitcher fall the ball into the catcher's glove. The smaller the dot the better the pitch, the larger the dot means the pitcher is not braking the curve enough or his slider is not sliding tight enough.

As to the batter, this red dot helps the batter follow the ball into his hitting zone. Sometimes most hotters have a hard time doing with the hit ball. The red dot helps his eye sight and time after practing with this new ball.

The catcher will also benefit by following the red dot, and he will be able to let the pitcher know if he is throwing the ball correctly. This should make him a more valuable catcher for the team.

Further advantage can also be obtained for the fielder as he will be able to follow the flight of the ball more closely and be in proper position for the catch.

DESCRIPTION OF THE DRAWINGS

The various objects and features of the present invention will be more fully understood by reference to the accompanyinng drawings.

With reference to FIG. 1, the marked ball is shown as 11, one of the colored marking is shown as 12 and a different colored spiral marking is shown as 13.

With reference to FIG. 2, which is a side view of the ball shown in FIG. 1, the ball is shown as 11, one of the spiral markings is shown as 12 and the other as 13.

With reference to FIG. 3 which is a side view of a ball marked with a single colored spiral marking the ball is shown as 14 and the marking is shown as 15. With reference to FIG. 4, the ball is shown as 17, with one of the line markings in one color is shown as 16, a second color is shown in marking 20 and the third color is is shown as 18 with a four color as 18. The colors can vary as needed or desired.

With reference to FIG. 5, the ball is shown as 21 with the colored marking on the seams of the ball shown as 22.

DETAILED DESCRIPTION OF THE INVENTION

The balls used in the present invention may be any conventional type base ball with any type of cover. Preferably, the ball is a hard ball used in regular baseball, but it can also be a softball.

Figure 1:
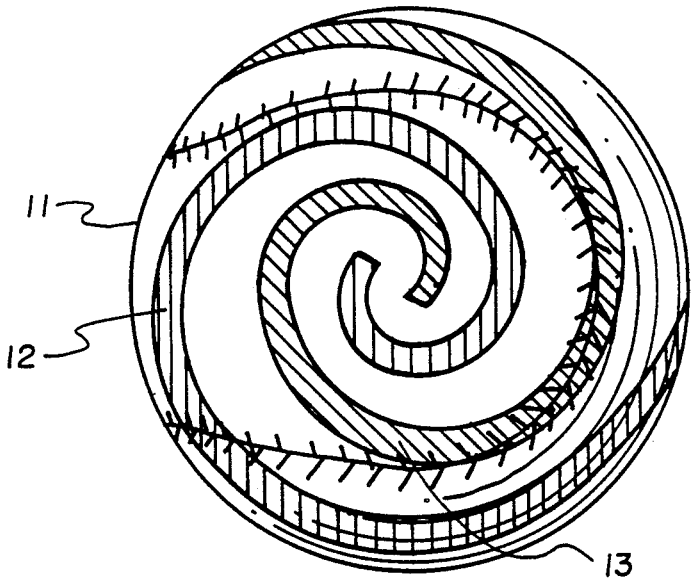
FIG. 1 is a top view of a baseball showing a two colored spiral around the cover of the ball.
Figure 2:
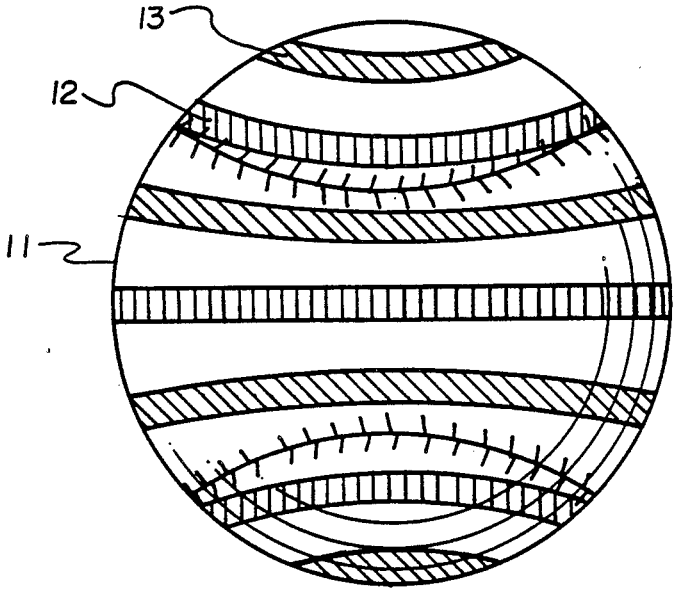
FIG. 2 is a side view of the ball shown in FIG. 1.
Figure 3:
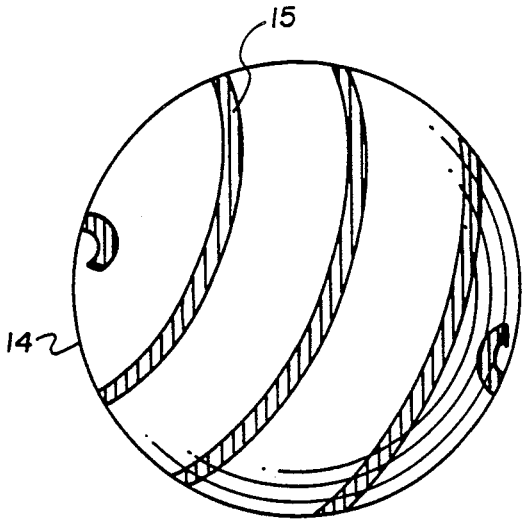
FIG. 3 is a side view of a baseball where the spiral is shown only in one cover.
Figure 4:
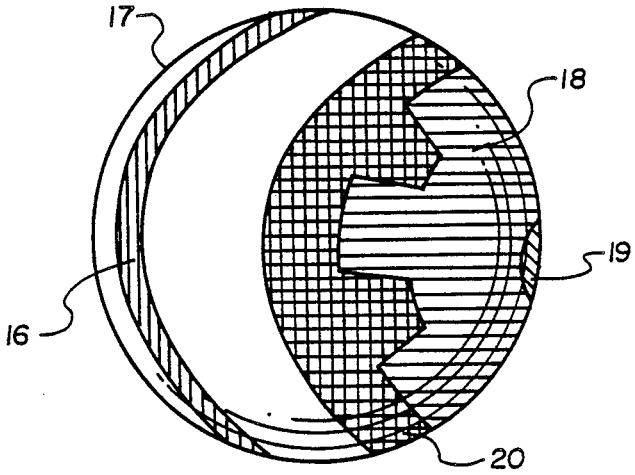
FIG. 4 is a baseball have a plurality of different shaped markings and a plurality of covers.
Figure 5:
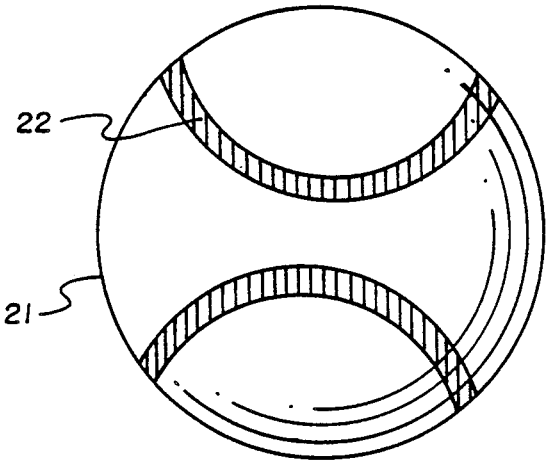
FIG. 5 is a baseball wherein the colored marking is on the seam of the ball.

The design on the marking of the cover may vary as desired. For example, it may be a line marking, a spiral line marking, design as in FIG. 4 and the like.

The colors employed may also vary as desired. In most cases, red is desirable as it is more easily seen when the ball is thrown. However, other colors, such as blue, green, yellow and the like make be used alone or together as in FIG. 4.

To make the markings meet the needs, it is preferred to to have the markings at least $\frac{3}{4}$ to $\frac{1}{2}$ inches in thickness, and more preferably about $\frac{3}{4}$ inch.

The marking may be accomplished by painting, printing or other suitable marking that will not rub off when the ball is utilized. Regular painting is preferred in most cases using conventional design or house paint.

I claim as my invention:

1. A baseball training apparatus comprising;

a regulation baseball having a continuous spiraling line on its surface, said line extending from a first point on the ball surface and spirals to a second point on the ball surface, said first and second points being positioned at spaced locations on a diametrical axis of the ball; said line having a width selected from the range of one-fourth to one-half inch and a single color selected from the group, red, green, yellow or blue; said ball when thrown will display a dot as seen by a pitcher, batter or catcher.

2. A baseball training apparatus as defined in claim 1 wherein said line has a combination of colors selected from the group red, green, yellow or blue.

* * * * *